United States Patent [19]

Piperkovski

[11] Patent Number: 4,833,949

[45] Date of Patent: May 30, 1989

[54] ADJUSTABLE OPEN-END WRENCH

[76] Inventor: Trajce Piperkovski, 4315 Ewers St., Detroit, Mich. 48210

[21] Appl. No.: 237,451

[22] Filed: Aug. 29, 1988

[51] Int. Cl.[4] ..... B25B 13/12

[52] U.S. Cl. ..... 81/127; 81/134

[58] Field of Search ..... 81/126, 127, 129, 129.5, 81/134, 135, 137, 146, 147

[56] References Cited

U.S. PATENT DOCUMENTS

| | | | |
|---|---|---|---|
| 1,434,753 | 11/1922 | Shackford | 81/127 |
| 1,628,842 | 5/1927 | Horsburgh | 81/126 |
| 1,660,208 | 2/1928 | Preining | 81/127 |
| 1,771,172 | 7/1930 | Fraser | 81/127 |
| 2,509,637 | 5/1950 | Gross | 81/126 |
| 4,602,533 | 7/1986 | Dunn | 81/134 |

*Primary Examiner*—Debra Meislin

*Attorney, Agent, or Firm*—Harness, Dickey & Pierce

[57] ABSTRACT

An adjustable open-end wrench is formed with a C-shaped base jaw member having an upper base grip-forming portion and a lower tongue-forming portion which is pivotally connected to an elongated handle. An L-shaped, sliding jaw member has a horizontal leg which is slidably guided between the upper and lower portions of the base jaw member. The sliding jaw member has an upright leg forming a movable grip portion opposing the base grip portion. Corresponding, normally interengaging, tooth-like locking formations are formed on the upper end of the handle and the lower edge of the movable jaw member horizontal leg for normally locking the jaw members relative to each other. The handle may be pivoted to temporarily release the interengaging locking formations so that the movable jaw member may be slidably moved relative to the base jaw member for adjusting the distance between the grip portions to accommodate to different size bolts and nuts.

12 Claims, 2 Drawing Sheets

ADJUSTABLE OPEN-END WRENCH

BACKGROUND OF INVENTION

This invention relates to an improved adjustable open-end wrench and more particularly to a simplified mechanism for one-hand adjustment of the wrench size.

Conventional adjustable open-end wrenches generally comprise a base jaw member, which is connected to a handle, and a movable jaw which is mounted upon the base jaw member. Various types of mechanisms have been provided for adjusting the location of the movable jaw member towards and away from the base jaw member and for maintaining it in position after the required distance between the grip portions of the jaw members is selected. One common way of adjusting the position of the movable jaw member is by means of a manually turned screw which moves the movable jaw towards or away from the base jaw member. This type of screw mechanism requires some time and care for properly adjusting the gap between the wrench base and movable jaw grip portions. Frequently, the grips are initially placed too close together or too far apart for a particular size bolt head or nut and, therefore, further careful adjustment is required.

In another type of adjustable open-end wrench mechanism, the movable jaw member is slidably mounted upon the base or fixed jaw member and is fixed in position by a ratchet or interengaging tooth system. This is illustrated in U.S. Pat. No. 1,434,753 issued Nov. 7, 1922 to Shackford.

Since open-end wrenches are susceptible to corrosion, their movable parts, particularly their adjustment mechanisms, tend to jam when corroded. Consequently, unless such wrenches are kept free of corrosion, they frequently become unusable when they have not been used for some while.

Further, prior open-end, adjustable-type wrenches are relatively complex in construction so that they are relatively expensive considering their purpose. Also, since they usually include a number of complex movable parts, they can be easily damaged.

Summarizing, there has been a need for a simply constructed, one-hand operated adjustable wrench which has virtually no moving parts and which will operate without difficulty, notwithstanding corrosion or dirt accumulations, and which is inexpensive to manufacture. The wrench of this present invention fills that need.

SUMMARY OF INVENTION

The invention herein contemplates an adjustable, open-end wrench which is formed of basically three parts, namely, a squared, C-shaped base jaw member, a handle pivotally connected to the lower portion of the base member and a horizontally slidable L-shaped movable jaw member whose lower leg is slidably mounted upon and guided by the C-shaped base member. Saw tooth locking formations are formed on the lower edge of the movable jaw member leg for interengaging with corresponding saw tooth locking formations formed on the upper edge of the handle. Pivoting the handle in one direction relative to the base jaw member separates the interengaging locking formations so that the L-shaped movable jaw, upright grip-forming leg may be moved towards and away from the grip-forming portion of the base member. Then, pivoting the handle reversely causes the tooth formations to interlock for immobilizing the jaws relative to each other.

A suitable spring means is provided to urge the movable jaw towards the base jaw so that the user can hold the wrench in one hand, manipulate the handle relative to its pivot for disengaging the locking formations and then easily position the movable jaw member around a particular nut or bolt to be grasped. Then, when the handle is turned in a normal, wrench-operating direction, the locking formations re-engage to automatically immobilize the two jaw members relative to each other for grasping the nut or bolt head. No fine adjustments or manipulations are required to properly space the opposing jaw grip portions for grasping a bolt head or nut between them.

An object of this invention is to provide an adjustable open-end wrench formed of only a few parts, which are inexpensive to manufacture and which will operate properly, notwithstanding corrosion, damage or dirt.

Another object of this invention is to provide an easily adjustable open-end wrench which can be adjusted accurately with one-hand movement and which automatically closely grips the head of a bolt or a nut without the need for fine adjustment.

Still another object of this invention is to provide an open-end wrench having a simple, integrated adjustment means which eliminates separate screws or other separate adjustment mechanism parts.

These and other objects and advantages of this invention will become apparent upon reading the following description, of which the attached drawings form a part.

DESCRIPTION OF DRAWINGS

FIG. 6 is a perspective view of the wrench parts disassembled.

DETAILED DESCRIPTION

Figure 7:
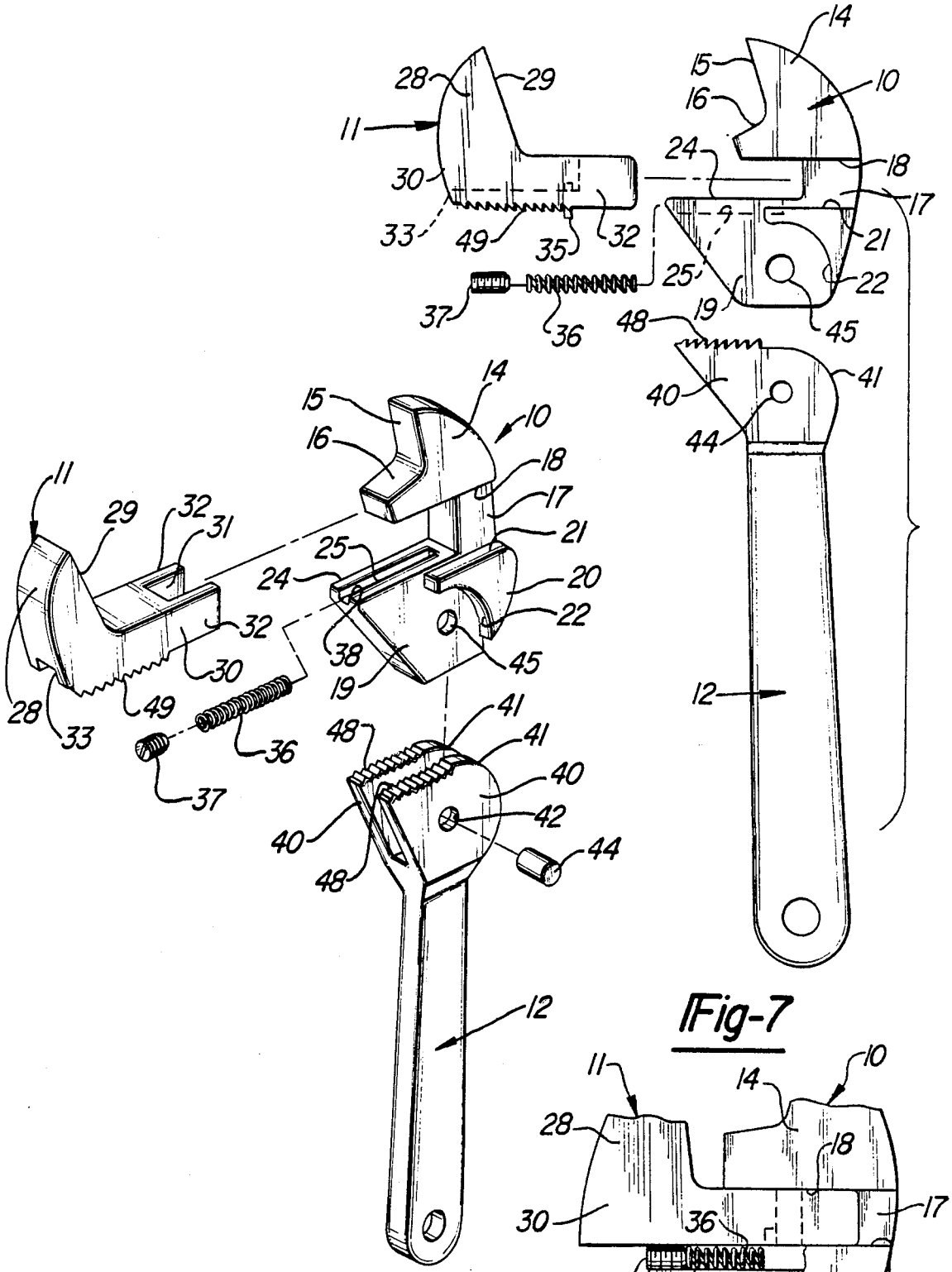
FIG. 7 is an elevational view of the wrench parts shown disassembled.
Figure 8:
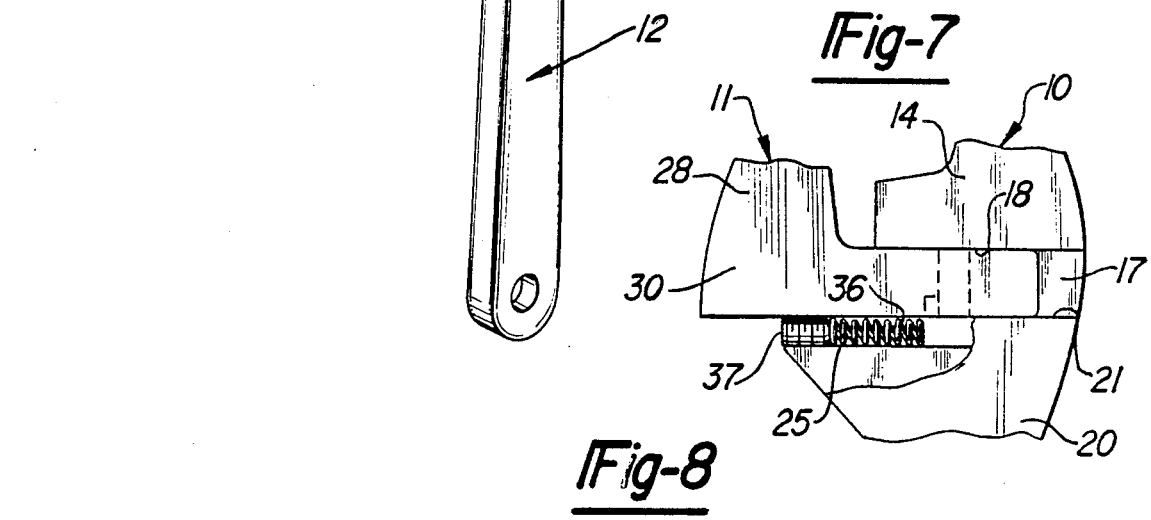
FIG. 8 is an enlarged, somewhat schematic, cross-sectional view of a fragment of the wrench illustrating the spring means for urging the movable and base grips together.

The wrench is formed of an assembly of three major elements, namely, a base jaw member 10, a sliding jaw member 11 and a handle 12. Each of these elements are illustrated in FIGS. 7 and 8.

The roughly C-shaped, base jaw member 10 is formed with an upper grip portion 14 having a grip surface 15 and a grip base surface 16. A narrower center connector portion 17 is formed integral with the upper grip portion 14. Because the connector is narrower than the grip portion, upper guide shoulders 18 are formed at its juncture with the grip portion.

A lower, flat, plate-like, tongue portion 19 is formed integral with the center connector 17. Integral side extensions 20 are formed on this tongue portion to provide elongated, lower guide shoulders 21. In addition, the lower surfaces of the side extensions 20 are curved to form an approximately one-quarter circle segment which provides a curved guide or bearing 22.

The top edge 24 of the tongue portion 19 is straight to form a guide rail. A substantially circular cross-section hole 25 is formed in the tongue portion adjacent its top edge. The wall defining the hole is open along the straight, top edge so that the hole forms a substantially circular cross-section 25 along the straight edge.

The sliding jaw member 12 is generally L-shaped to provide an upright leg 28 having a movable grip surface 29. The horizontal leg 30 of the jaw member 12 is formed with a notch 31 to provide two, spaced apart leg segments 32. In addition, an elongated, straight groove 33 is formed in the bottom surface of the horizontal leg 30.

A bearing pin 35 is secured to the bottom surface of the horizontal leg. This may be accomplished by drilling a hole in the leg and securing the pin 35 within the hole by an interference or friction fit or the pin may be welded in the hole. An elongated, coil spring 36 is inserted in the slot 25 to resiliently press the pin 35 in a direction which causes the L-shaped jaw member 12 to move towards the base jaw member center connector 17. Thus, the L-shaped sliding jaw member 12 is mounted with its two leg segments 32 on the opposite sides of the center connector 17 so that the leg is guided between the upper and lower guide shoulders 18 and 21 and by the connector 17. The upper edge of the tongue 19 slidably fits within the groove 33 in the lower surface of the horizontal leg 30. Hence, sliding movements of the L-shaped sliding jaw member 12 relative to the base jaw member moves the movable grip surface 29 towards and away from the base jaw member grip surface 15.

The coil spring 36 is retained within the slot 25 by means of a small set screw 37 which threadedly engages with the threaded end 38 of the circular cross-section slot 25. Thus, to assemble the unit, the horizontal leg 30 is moved towards the connector portion 17 of the base jaw member and, by slightly swinging the horizontal leg 30, the pin 35 is inserted within the slot 25. Then, the coil spring 36 may be inserted into the open end of the slot 25. After that, the set screw 37 may be threadedly engaged within the slot threaded end 38 to retain the parts and to spring bias the two jaw members together.

The upper end of the handle 12 is bifurcated to provide two parallel, spaced apart legs 40. The bottom portion of the tongue 19 closely fits between these two legs. The legs are provided with circular curvature portions 41 which bear against the circular or curved guide or bearing surfaces 22 of the side extensions 20 on the tongue 19. Then, the legs 40 are pivotally connected to the tongue by means of pivot holes 42 in the legs which receive a pivot in 44 that extends through an aligned hole 45 in the tongue 19.

The top surfaces of the handle legs 40 each are formed with a saw tooth-like locking formation 48. These interengage with corresponding saw tooth-like locking formations 49 formed on the bottom of the horizontal leg 30 on each side of the notch 31 formed in the horizontal leg.

Figure 1:
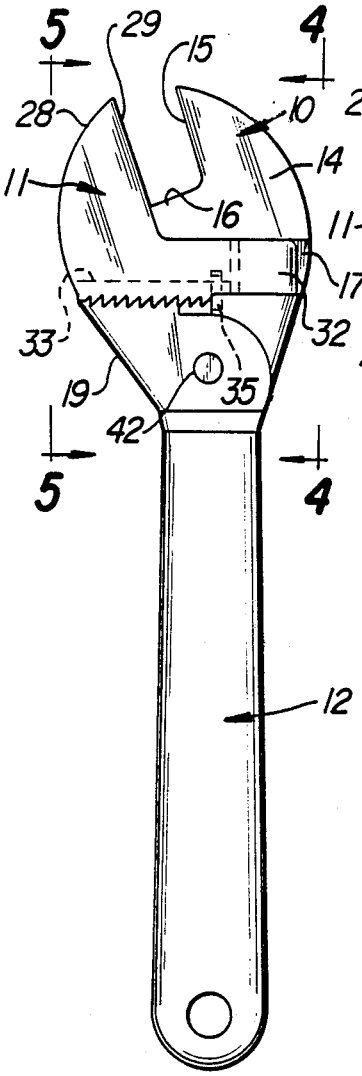
FIG. 1 is an elevational view of the adjustable, open-end wrench of this invention.
Figure 2:
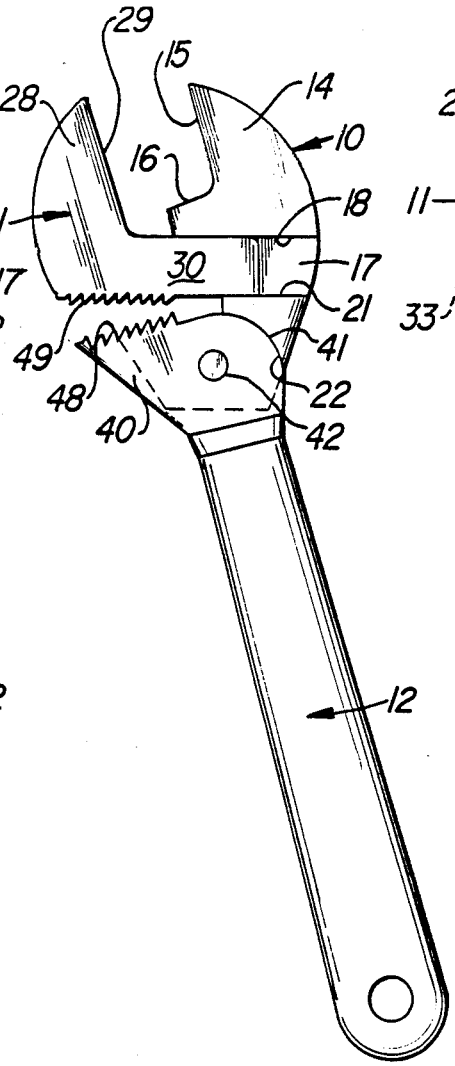
FIG. 2 is a view similar to FIG. 1, but showing the pivoting of the handle for separating and disengaging the saw tooth locking formations on the handle and on the movable jaw member.
Figure 3:
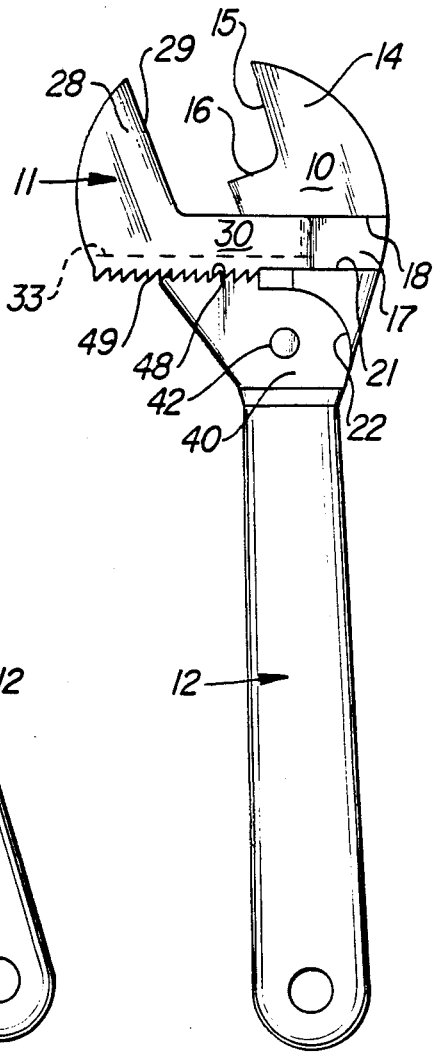
FIG. 3 in a view similar to FIG. 1, illustrating the movable jaw member grip portion arranged at a substantial distance from the base jaw member grip portion, as for example, for engaging a large bolt head.
Figure 4:
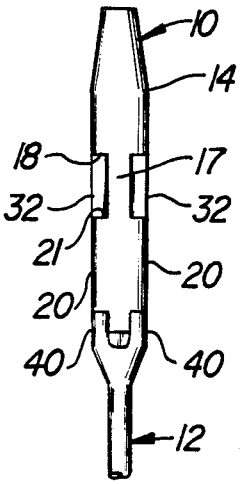
FIG. 4 is a side view taken in the direction of arrows 4—4 of FIG. 1.
Figure 5:
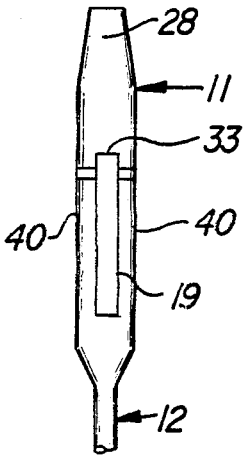
FIG. 5 is an opposite side view taken in the direction of arrows 5—5 of FIG. 1.

In operation, the wrench is normally in the condition shown in FIG. 1, that is, with the grip surface 15 of the base jaw member 10 relatively close to the grip surface 29 of the sliding jaw member. To increase the gap between the grip surfaces to fit different size bolt heads or nuts, the handle is pivoted slightly to disengage the saw tooth locking formations 48 and 49, as illustrated in FIG. 2. Then, the sliding jaw member 12 is moved either manually or by engagement with the nut or bolt head. Such movement opposes the resilient resistance of the coil spring 36 which resiliently forces the movable grip surface 29 against the side of the nut or bolt which is opposite to the side which is engaged by the grip surface 15. As soon as the nut or bolt is snugly engaged between the opposed grip surfaces, the user moves the handle in a direction to turn the nut or bolt. The pivoting movement of the handle causes the saw tooth locking formations to automatically interengage again. This immobilizes the sliding jaw, as illustrated in FIG. 3.

The pivoting of the handle and the movement of the slidable jaw can be accomplished with one hand. The movable jaw remains in position during the time that the wrench is turned because pressure on the handle causes the locking formations to remain interengaged under the pressure of the handle.

This invention may be further developed within the scope of the following claims. Accordingly, it is desired that the claims be read as being merely illustrative of an operative embodiment and not in a strictly limiting sense.

Having fully described an operative embodiment of this invention, I now claim:

1. An adjustable size, open-end wrench comprising:

a roughly C-shaped base jaw member having an upper portion forming a base grip, a lower portion forming a substantially flat, plate-like tongue having an exposed, upper, straight, horizontally elongated edge, and a center portion interconnecting the upper and lower portions and forming a guide;

a roughly L-shaped sliding jaw member having an upright portion forming a movable grip positioned oppositely to said base grip, and a generally horizontal leg, whose free end is notched to slidably receive and to fit around the opposite sides of the base grip center portion and which is slidably engaged with the exposed upper edge of the base jaw member lower portion for slidably moving the movable grip towards and away from the base grip;

an elongated, upright handle having its upper end bifurcated to form a pair of parallel, spaced apart legs;

said base jaw member tongue being closely fitted between said handle legs, and a pivot pin pivotally extending through the legs and tongue for connecting them together;

at least one of said handle legs having a locking formation means formed on its upper edge which formation releasably interengages with a corresponding locking formation means formed on the lower edge of the sliding jaw horizontal leg;

whereby the handle may be pivoted relative to the jaw member in a direction to separate the interengaged sliding jaw leg and handle leg locking formation means so that the sliding jaw member may be slid endwise for moving its movable grip portion to adjust the wrench opening provided between the base and movable grips and may be locked relative to the base jaw member by pivoting the handle in the opposite direction to again interengage the locking formation means.

2. A wrench as defined in claim 1, and including a spring means normally spring-urging the movable grip towards the base grip, so that when said locking formation means are separated, the sliding jaw member movable grip portion must be forced away from the base grip portion with sufficient force to overcome the force of the spring means.

3. A wrench as defined in claim 2, and including an elongated, straight groove formed along the lower surface of the sliding jaw member horizontal leg, with the upper edge of said tongue fitted within said groove for guiding the jaw member relative to the tongue.

4. A wrench as defined in claim 1, and including a spring means normally urging the sliding jaw member movable jaw towards the base grip, with said spring means including an elongated slot formed in one of, and a projection extending into the slot from the other of, the tongue upper edge and the sliding jaw member lower leg, with the spring engaging the projection and urging it in the direction towards moving the sliding jaw member grip against the base grip.

5. A wrench as defined in claim 4, and including a locking formation means formed on both of the upper edges of the handle legs for releasably engaging with corresponding locking formation means formed on the lower edge of the sliding jaw leg portions located on both sides of the groove formed in the sliding jaw leg.

6. A wrench as defined in claim 5, and including the base jaw member grip portion being thickened above and below its center portion to provide guide shoulders for holding and for guiding the sliding jaw member horizontal leg portions which overlap said center portion.

7. A wrench as defined in claim 1, and including said locking formation means being formed of corresponding saw tooth-like serrations which interengage.

8. A wrench as defined in claim 7, and including said locking formation means being formed on both of the upper edges of the handle legs for releasably engaging with corresponding locking formation means formed on the lower edge of the sliding jaw leg portions.

9. An adjustable size, open-end wrench comprising a roughly C-shaped base jaw member having an upper portion forming a base grip, a lower portion forming a substantially flat, plate-like tongue having an exposed, upper, straight, horizontally elongated edge, and a narrow center portion interconnecting the upper and lower portions and forming a guide;

a roughly L-shaped sliding jaw member having an upright portion forming a movable grip positioned oppositely to said base grip, and having a generally horizontal leg which is notched to slidably receive and fit around the opposite sides of the base grip center portion and which is slidably engaged with the exposed upper edge of the base jaw member lower portion for slidably moving the movable grip towards and away from the base grip;

an elongated, upright handle having its upper end bifurcated to form a pair of parallel, spaced apart legs arranged on opposite sides of the base jaw member tongue which is closely fitted between said legs;

pivot means pivotally interconnecting said spaced apart legs and the tongue;

at least one of said handle legs having a saw tooth-like locking formation formed on its upper edge for releasably interengaging with a corresponding saw tooth-like formation formed on the lower edge of the sliding jaw horizontal leg;

a spring means normally spring-urging the movable grip towards the base grip;

whereby the handle may be pivoted relative to the base jaw member in a direction to separate the interengaged sliding jaw leg and handle leg saw tooth locking formations so that the sliding jaw member may be slid endwise relative to the base jaw member for moving the movable grip towards and away from the base grip for adjusting the distance therebetween, and the movable jaw may be immobilized relative to the base jaw grip by pivoting the handle in the opposite direction to again interengage the saw tooth-like locking formations.

10. A wrench as defined in claim 9, and including a continuous, elongated groove formed in the lower surface of the sliding jaw member horizontal leg, with the upper edge of said tongue portion being fitted within said groove for guiding the jaw member relative to the tongue.

11. A wrench as defined in claim 10, and including a similar saw tooth locking formation formed on both of the upper edges of the handle legs for releasably interengaging with corresponding saw tooth-like locking formations formed on the lower edge of the sliding jaw horizontal leg portions located on both sides of the groove formed therein.

12. A wrench as defined in claim 11, and including horizontally arranged guide shoulders formed on the upper and lower ends of the central portion of slidably engaging the upper and lower edges of the sliding jaw member horizontal leg for guiding the portions of that leg which overlap said center portion.

* * * * *